United States Patent [19]

Mollet et al.

[11] 4,426,602

[45] Jan. 17, 1984

[54] LOW-PRESSURE MERCURY VAPOR DISCHARGE LAMP

[75] Inventors: Adrianus J. T. Mollet, Roosendaal; Rudolf Sanders, Eindhoven, both of Netherlands

[73] Assignee: U.S. Philips Corporation, New York, N.Y.

[21] Appl. No.: 268,208

[22] Filed: May 29, 1981

[30] Foreign Application Priority Data

Jun. 4, 1980 [NL] Netherlands ..... 8003277

[51] Int. Cl.[3] ..... H01J 7/44; H01J 61/56

[52] U.S. Cl. ..... 315/58; 315/59; 315/DIG. 5; 313/318; 313/493; 313/634

[58] Field of Search ..... 315/58, 59, DIG. 5; 313/220, 284, 318, 357, 493, 51, 634; 339/144 R, 145 D

[56] References Cited

U.S. PATENT DOCUMENTS

| | | | |
|---|---|---|---|
| 3,501,662 | 3/1970 | Plagge | 313/493 |
| 4,050,763 | 9/1977 | Smithgall | 313/318 X |
| 4,324,447 | 4/1982 | van der Wolf et al. | 313/220 X |

FOREIGN PATENT DOCUMENTS

| | | | |
|---|---|---|---|
| 45-12089 | 5/1970 | Japan | 313/318 |

*Primary Examiner*—Eugene R. Laroche
*Assistant Examiner*—Vincent De Luca
*Attorney, Agent, or Firm*—Norman N. Spain

[57] ABSTRACT

Low-pressure mercury vapor discharge lamp having a discharge vessel (1, 2, 3) which contains with mercury and a rare gas and is of such a shape that the ends of the discharge vessel where the electrodes (4, 5) are arranged are in a side-by-side relationship, these ends being connected to a lamp base (8) which has an axially projecting sleeve-shaped wall portion (12) of a cross-section which deviates from the circular and in which at least a starter (13) is included, a respective connecting pin (10, 11) which is shorter than the length of the projecting wall portion being provided on either side of the said projecting wall portion.

The projecting portion serves as a locating guide when inserting the lamp base in a holder (15), thereby inter alia preventing damage to the pins, and also serves as a housing for a starter switch (13) and a capacitor (14).

3 Claims, 2 Drawing Figures

LOW-PRESSURE MERCURY VAPOR DISCHARGE LAMP

The invention relates to a low-pressure mercury vapour discharge lamp having a tubular discharge vessel which is closed in a vacuum-tight manner, electrodes between which the discharge is maintained during operation of the lamp being arranged one at each end of the discharge vessel, the discharge vessel containing mercury and a rare gas and being of such a shape and dimensioned in such a manner that the said ends of the discharge vessel are in a side-by-side relationship at one and the same end of the lamp, the said ends of the vessel being connected to a lamp base provided with connecting pins. Such a lamp is disclosed in U.S. Pat. No. 3,501,662.

The lamp described in the above-mentioned United States Patent Specification has a lamp base provided with four axially extending connecting pins which are connected to the leads for the electrodes and which are in a side-by-side relationship. During operation of the lamp a U-shaped discharge path is formed between these electrodes (which are arranged at the ends of, for example, a U-shaped discharge tube or at the ends of two juxtaposed parallel elongate discharge tubes whose other ends are inter connected as described in the above-mentioned Patent Specification). The known lamp can be placed in a holder which cooperates with the lamp base, the connecting pins being, for example, clamp-fitted in the current-carrying sockets in the holder.

When a user places the above-described lamp in a holder it may happen that distortion of the connecting pins occurs due to forces laterally applied thereto. This adversely affects the spacing between the pins. In addition, damage to the lamp base is not inconceivable.

Special measures are necessary in order to obviate these disadvantages. The holder may, for example, be provided with a thin, high vertical edge to guide the lamp base when the lamp is inserted into the holder. This results in a bulky and vulnerable holder. Added to this is the fact that, in the holder which cooperates with the known lamp or in the luminaire in which the holder has been placed, special space must be reserved for the accommodation of a starter for starting the lamp.

It is an object of the invention to provide a lamp with lamp base, wherein during use the risk of damage to the lamp base or the connecting pins included therein is as small as possible, a positioning of the lamp in a holder cooperating therewith in either of two positions due to symmetrical arrangement being obtained at the same time, no external accommodation for the starter being necessary.

According to the invention, a low-pressure mercury vapour discharge lamp of the type described in the opening paragraph is characterized in that the lamp base has an axially projecting sleeve-shaped wall portion, having a non-circular cross-section, in which at least a starter is included, the connecting pins being shorter than the length of the projecting wall portion and being located one on either side of the projecting wall portion.

A lamp in accordance with the invention can be inserted in such manner in a holder which cooperates with the lamp base that the risk of damage to the connecting pins is considerably reduced. Namely, the sleeve-shaped wall portion extends beyond the pins, so that when the lamp is placed in the holder any laterally directed forces are taken up by the sleeve-shaped wall portion and substantially not by the pins. For the purpose of receiving the said projecting wall portion, a suitable holder is provided with a sleeve-shaped recess cooperating therewith. Further said projecting wall portion acts as a housing for the starter, so no external accommodation for said starter has to be provided.

The axially projecting sleeve-shaped wall portion of the lamp base has a non-circular cross-sectional shape so that the lamp can be positioned on either of two positions in the holder due to symmetrical arrangement. This is particularly important for lamps having a discharge vessel of such a shape that the discharge path is located in a flat plane, such as for example in the case of a tubular discharge vessel which has been bent into a U-shape or in the case of a lamp having a shape as described in the above-mentioned United States Patent Specification. Namely, the quantity of light emitted by these lamps is not the same in all directions. In addition, damage to connecting pins when placing the lamp in a holder is prevented, as rotation of the lamp about the main axis of the sleeve-shaped wall portion is not possible. A lamp in accordance with the invention has furthermore the advantage that no additional provisions for the inclusion of a starter need be provided in the lamp holder or in the luminaire in which the lamp is to be placed.

The lamp in accordance with the invention can be positioned in a holder with a sleeve-shaped wall portion which in cross-section is, for example elliptical or polygonal. Preferably, the projecting wall portion has a rectangular cross-section. A lamp base having such a sleeve-shaped wall portion can be manufactured in a relatively simple manner. In addition, not only a starter but also a capacitor which shunt this starter can be placed within the space enclosed by the sleeve-shaped wall portion. Such a capacitor is generally arranged outside the starter.

The lamp base may be connected in the holder in a detachable manner such that only the sleeve-shaped projecting wall portion of the lamp base is included in a clamping manner in a recess cooperating therewith in the holder. Preferably, the projecting wall portion is provided at the outside with projections for detachably locking the lamp base in a holder cooperating therewith. The lamp base is, for example, locked by means of resilient lugs placed in the holder, the ends of these lugs gripping the projections. The projections may, for example, be provided one on either side of the sleeve-shaped projecting wall portion of the lamp base and facing the connecting pins. It is alternatively possible to provide the projections on those wall portions which extend in parallel with a plane through the pins.

An embodiment of the invention will now be further explained with reference to the accompanying drawing, in which.

Figure 1:
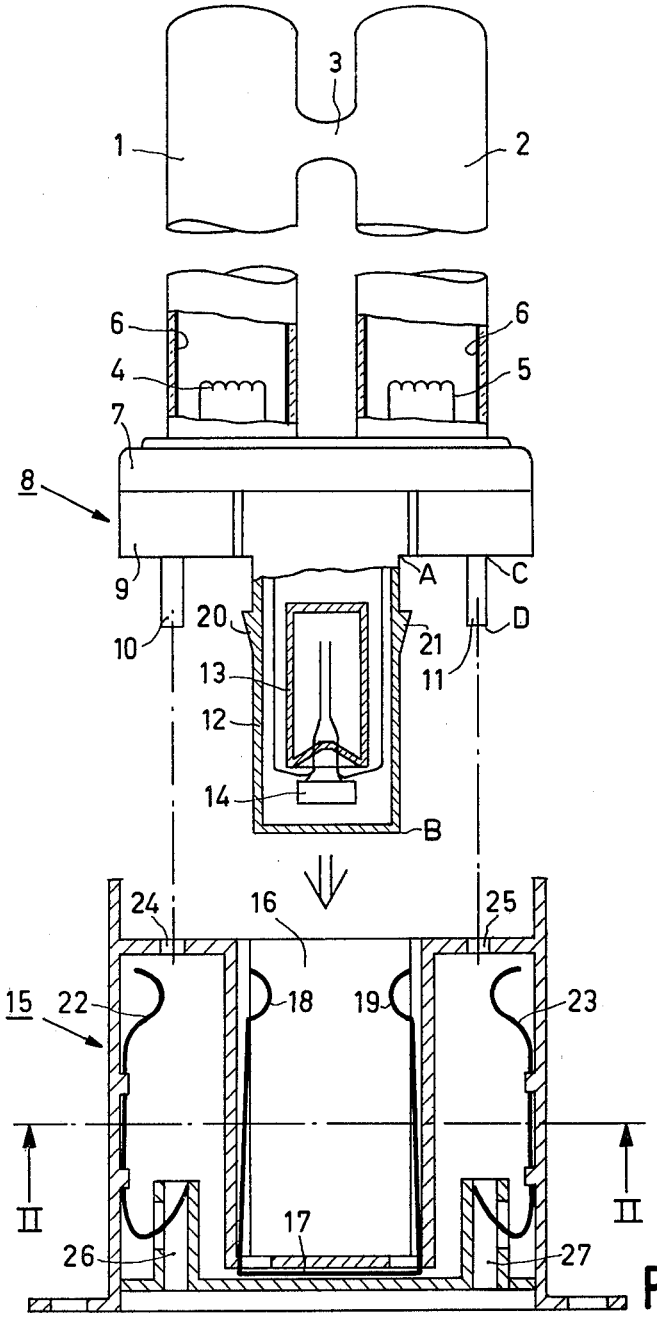
FIG. 1 shows partly an elevational view, partly a longitudinal cross-sectional view of an embodiment of a low-pressure mercury vapour discharge lamp according to the invention with (in longitudinal cross-sectional view) a holder cooperating with the lamp base.
Figure 2:
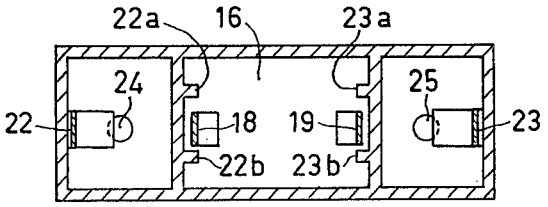
FIG. 2 shows a cross-sectional view along the plane II—II of a holder shown in FIG. 1.

The low-pressure mercury vapour discharge lamp shown in FIG. 1 comprises a tubular discharge vessel (filled with mercury and a rare gas) which is closed in a vacuum-tight manner and consists of two parallel extending discharge tubes 1 and 2, which are interconnected by means of a cross-connection 3. Electrodes 4 and 5 are placed in a side-by-side relationship, one at the end of each tube 1 and 2. During operation of the lamp a U-shaped discharge path is formed between the electrodes. A luminescent layer 6 which converts the ultraviolet radiation generated in the mercury discharge into visible light is provided on the inside of the walls of the discharge tubes 1 and 2. At the ends of the tubes 1 and 2, in the region of the electrodes, an oval wall portion 7 (consisting, for example, of aluminum) of a lamp base 8 is fastened to the tubes by means of a suitable cement. Connected to this portion 7, for example by means of a riveted connection, is a second portion 9 of the lamp base, made for example of an insulating (e.g. plastics) material. This second portion 9 is provided with connecting pins 10 and 11, which are located one on either side of an axially projecting sleeve-shaped wall portion 12 which is integral with portion 9. This sleeve-shaped wall portion is of a rectangular cross-section and includes a glow discharge starter 13 (having a glass envelope in which there are two bimetal contact strips) and a capacitor 14, which is electrically connected in parallel therewith for trouble-free starting of the lamp. The said starter is connected to one of the leads of the electrodes 4 and 5. The other leads of the electrodes are fastened in the current supply pins 10 and 11, which are, for example, in the form of hollow copper pins. The current supply pins are consideraby shorter than the sleeve-shaped wall portion 12. In a practical embodiment the ratio between the length AB (17.0 mm) and the length CD (approximate 6.5 mm) is approximately 2.5. In the embodiment according to FIG. 1 said ratio is approximately 4. When the lamp is being inserted into a holder 15 which cooperates with the lamp base, the pins 10 and 11 (mutual spacing approximately 23 mm) are not damaged this being due to the locating function of portion 12 which is approximately $12 \times 15$ mm in cross-section. The holder 15 is provided with a recess 16 into which the portion 12 can be inserted. When the lamp has been fully inserted in the holder 15, the walls of portion 12 and recess 16 face each other. When the lamp is used in the horizontal position, the wall of recess 16 serves as a supporting plane for portion 12. The recess 16 has a rectangular cross-section (as has portion 12), see also FIG. 2, causing the lamp to be positioned in the holder in either of two positions due to symmetrical arrangement. The holder also comprises a metal strip 17 having resilient ends 18 and 19, which grip around respective projections 20 and 21 on the wall of portion 12 for locking the lamp in the holder in a detachable manner. Preferably, the holder also consists of a plastics material.

On both sides of the strip 17 there are, in the wall of recess 16 in the holder, axially extending vertical ribs *22a—22b* and *23a—23b* (see FIG. 2) which serve to guide portion 12 of the lamp base when inserting the lamp. After having been inserted in the holder the current supply pins 10 and 11 are in electrical contact with current-carrying resilient metal strips 22 and 23 in the holder. To take up the pins 10 and 11, the holder is provided with two apertures 24 and 25. By means of sleeved apertures 26 and 27 in the wall of the holder, the current supply leads from an electric stabilization ballast (not shown) and mains can be connected to strips 22 and 23. It is also possible to provide the holder in an adapter which has, for example, a threaded sleeve and a stabilization ballast.

In an alternative embodiment, the projections 20 and 21 (and the elements 17 to 19 in the holder cooperating therewith) may be provided on the two walls the portion 12, which extend in parallel with the plane through the connecting pins 10 and 11.

What is claimed is:

1. A low pressure mercury vapor discharge lamp comprising a discharge tube closed in a vacuum-tight manner and containing mercury and a rare gas and electrodes, positioned one at each end of said discharge tube, for maintaining a discharge during operation of said lamp, said discharge tube being of such configuration that the ends thereof are in a side-by-side relationship at one end of the lamp and are both connected to a single lamp base provided with connecting pins, characterized in that the lamp base has an axially projecting wall portion having a non-circular cross-section positioned between said connecting pins, projecting beyond said pins and containing a starter for said lamp.

2. A low-pressure mercury vapour discharge lamp as claimed in claim 1, characterized in that the projecting wall portion has a rectangular cross-section.

3. A low-pressure mercury vapour discharge lamp as claimed in claim 1 or claim 2, characterized in that projections are provided on the outside of the projecting wall portion by means of which the lamp base can be locked in a detachable manner in a holder arranged to cooperate therewith.

* * * * *